United States Patent [19]

Le Bras

[11] Patent Number: 4,571,923

[45] Date of Patent: Feb. 25, 1986

[54] PACKAGING MACHINE AND METHOD

[76] Inventor: Philippe A. Le Bras, 13, Rue De La Bievre, 36000 Chateauroux, France

[21] Appl. No.: 683,746

[22] Filed: Nov. 19, 1984

[30] Foreign Application Priority Data

Dec. 19, 1983 [GB] United Kingdom ..... 8333706

[51] Int. Cl.[4] ..... B65B 21/24

[52] U.S. Cl. ..... 53/398; 53/48; 53/49

[58] Field of Search ..... 53/48, 49, 209, 534, 53/543, 398; 206/486

[56] References Cited

U.S. PATENT DOCUMENTS

| | | | |
|---|---|---|---|
| 2,817,197 | 12/1957 | Anness | 53/209 X |
| 3,543,474 | 12/1970 | Hasselo | 53/209 X |
| 3,805,478 | 4/1974 | Stohlquist | 53/534 X |
| 3,827,211 | 8/1974 | Zavatone | 53/48 |
| 3,956,868 | 5/1976 | Ganz | 53/543 X |
| 4,098,055 | 7/1978 | Calvert | 53/534 |
| 4,188,766 | 2/1980 | Culpepper | 53/48 |

FOREIGN PATENT DOCUMENTS

| | | | |
|---|---|---|---|
| 44491 | 1/1974 | Australia | 53/49 |
| 2250342 | 7/1975 | France | 206/486 |

*Primary Examiner*—John Sipos

*Attorney, Agent, or Firm*—Erwin Doerr

[57] ABSTRACT

A packaging machine (10) for wrapping together a plurality of uniform containers (c) which machine includes an infeed section (12) having conveying means (18) for continuously feeding a series of wrapper blanks in substantially flat condition longitudinally towards an outfeed section of the machine and conveying means (22,24) for continuously feeding a linear series of containers to be wrapped in longitudinal alignment with said series of wrappers so that each container is moved into a position directly above a wrapper blank, a loading section (20) in which each container is caused to be located in an aperture ('a') provided in a base panel of the wrapper while the container and wrapper are conveyed in synchronism, a forming section in which wrapping of further panels or each blank with respect to the containers is affected to complete the package and an outfeed section from which the completed packages leave the machine, characterized in that loading is achieved by causing the containers to enter the loading section at one level and the wrappers to enter the loading section at a relatively lower level and progressively raising each wrapper from the lower level to said one level when said containers are positioned above the wrapper so as to cause containers to locate in said apertures of the wrapper.

3 Claims, 2 Drawing Figures

PACKAGING MACHINE AND METHOD

Figure 1:
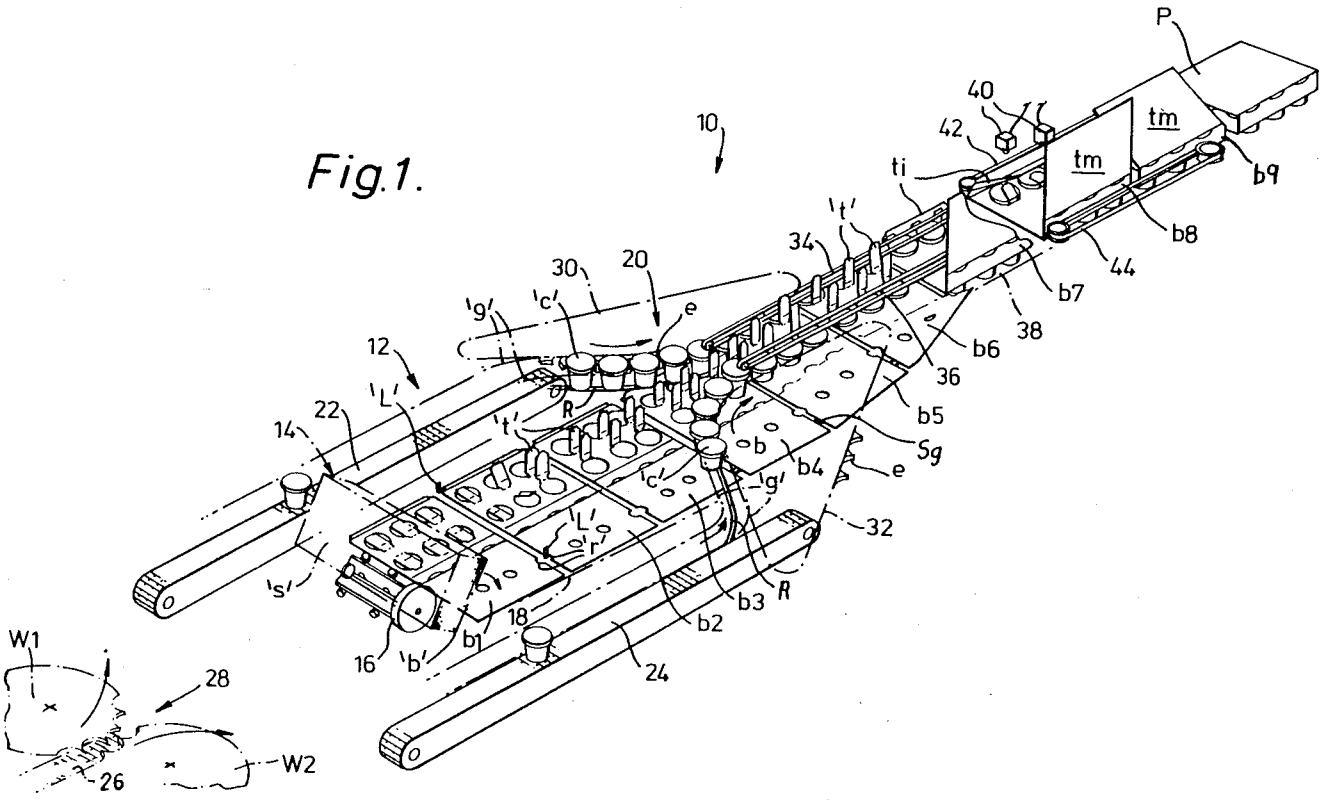

This invention relates to a machine and method for continuous in-line packaging of groups of containers to form multiple-unit packages and is particularly suitable for packing containers having flanged tops, e.g. cup-shaped pots containing yogurt or other products.

One aspect of the invention provides a method for wrapping together a plurality of uniform containers in a wrapper which method comprises continuously feeding a series of wrapper blanks in substantially flat condition longitudinally from an infeed section towards an outfeed section of a machine, simultaneously feeding a linear series of containers to be wrapped into longitudinal alignment with said series of wrappers so that each container is moved into a position directly above a wrapper blank, causing each container to be located in an aperture provided in a base panel of the wrapper while the container and wrapper are conveyed in synchronism through a loading section of the machine and wrapping further panels of each blank with respect to the containers to complete the package in a forming section of the machine following which the completed packages leave the machine, characterised in that loading is achieved by causing the containers to enter the loading section at one level and the wrappers to enter the loading section at a relatively lower level and progressively raising each wrapper from the lower level to said one level when said containers are positioned above the wrapper so as to cause containers to locate in said apertures of the wrapper.

Another aspect of the invention provides a packaging machine for wrapping together a plurality of uniform containers which machine includes a feed section having conveying means for continuously feeding a series of wrapper blanks in substantially flat condition longitudinally towards an outfeed section of the machine and conveying means for continuously feeding a linear series of containers to be wrapped into longitudinal alignment with said series of wrappers so that each container is moved into a position directly above a wrapper blank, a loading section in which each container is caused to be located in an aperture provided in a base panel of the wrapper, while the containers and wrappers are conveyed in synchronism, a forming section in which wrapping of further panels of each blank with respect to the containers is affected to complete the package and an outfeed section from which the completed packages leave the machine characterised in that said container conveying means includes means for causing the containers to enter the loading section at a level above that at which said wrappers enter the loading station and by means for progressively raising each wrapper blank from the relatively lower level to said container level when said containers are positioned above the wrapper so as to cause containers to locate in said apertures of the wrapper.

Figure 2:
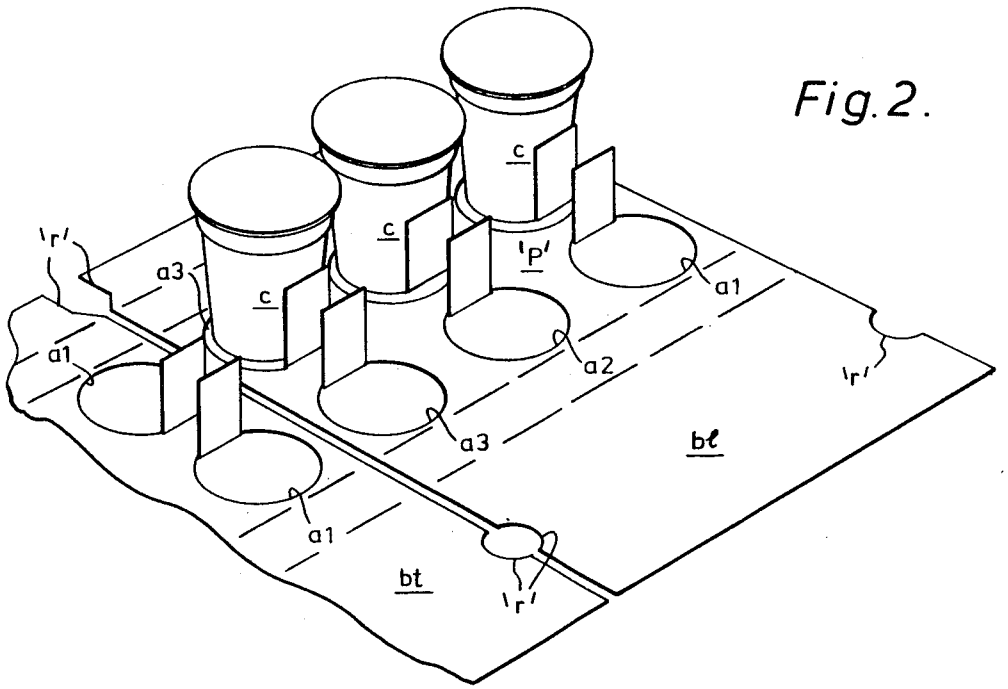

An embodiment of the invention will now be described, by way of example, with reference to the accompanying drawings, in which:

FIG. 1 is a schematic perspective view of a packaging machine according to the invention, and FIG. 2 is a perspective view showing the relative spacing arrangement between wrapper blanks and containers.

Referring to the drawings, a packaging machine 10 comprises an infeed section 12 having a hopper 14 holding a stack 's' of wrapper blanks 'b'. The blanks are successively withdrawn from the hopper by a timed withdrawal mechanism 16 and deposited on a wrapper infeed conveyor 18. The infeed conveyor 18 comprises endless belts such as chains (not shown) which incorporate upstanding lugs 'L' which engage in recesses 'r' formed in the leading and trailing edges of the wrapper blanks 'b', in the top wall panels of the wrapper.

Each blank is thus fed forwardly in substantially flat condition by a pair of the chain lugs 'L' pushing against the trailing edge of the blank towards a loading section 20 of the machine. The position of the lugs 'L' may be altered to accomodate blanks of a different width.

As best seen in FIG. 2, the base panel 'p' of each blank has a pair of parallel rows of apertures 'a' each sized to receive a container 'c'. The spacing of one blank 'b1' from the next succeeding blank 'bt' is fixed by the positioning of the chain lugs 'L' so that the distance between the trailing aperture 'a3' of the blank 'b1' to the leading aperture 'a1' of the blank 'bt' is equal to the distance between the apertures in the blanks themselves. Hence, the spacing of the apertures 'a' is as in a continuous web of material having equi-distant spaced apertures.

As the blanks are fed forwardly, an ejector device (not shown) located below the infeed conveyor 18 and which comprises a rotatable element having radially projecting fingers, presses out reinforcing tabs 't' from the plane of the blank into an upstanding position as shown with reference to blanks 'b2' and 'b3' in FIG. 1.

The wrapper infeed conveyor 18 is flanked on each of its sides by parallel container infeed conveyors 22 and 24, respectively, in the infeed section of the machine. The conveyors are endless belts and receive containers 'c' from a supply conveyor 26 upstream of the infeed section by passing through a known container separator device 28 comprising counter-rotating star wheels $W^1$, $W^2$. As the two rows of containers 'c' are fed forwardly on their respective conveyors they are constrained to move inwardly on convergent paths by guide bars 'g' mounted above conveyors 22 and 24, and the bases of the containers slide along a fixed support bar 'R' located between and below the guide bars 'g'. As the containers leave their respective infeed conveyors and onto the support bar R, they are engaged by spacer elements 'e' carried by endless belts 30 and 32 respectively, which maintain the containers upright and feed the containers along their respective support bars in convergent paths in spaced relationship inwardly and above the wrapper blanks into the loading section 20 of the machine. The containers 'c' are held spaced apart by the spacer elements 'e' such that the distance between successive containers is equal to the distance between successive apertures 'a' in the wrapper blanks (see FIG. 2). As the containers enter the loading section 20, as shown at the position of wrapper blank b4, they move directly above the blank b4 and are brought into parallel alignment longitudinally of the feed direction. The timing of the blank feed and of the container feed is synchronised so that successive containers are positioned above successive apertures of the blank. The downstream end of the wrapper infeed conveyor is downwardly inclined approximately 5° to the horizontal to allow clearance of the chain lugs 'L' to pass beneath the convergent container feed paths so that the blanks (see blank b3) are temporarily displaced downwardly. The leading edge of wrapper b4 begins to be displaced upwardly from its horizontal feed path by a ramp surface below the wrappers in the loading section and the leading apertures 'a' of blank 'b4' therefore receive the bases of the containers positioned thereabove. The ramp surface is provided by upwardly inclined static guides 'Sg' beneath the wrapper blanks. This position correpsonds to the outfeed end of the wrapper infeed conveyor at which the lugs 'L' disengage from the trailing edge of wrapper b4 and pass back along the return path of the conveyor to the upstream end of the infeed section.

The support bars on which the container bases are seated terminate immediately prior to the location at which the containers begin to be received in the blank apertures. Movement of the wrapper blanks up the static guide ramp surface is imparted by the containers engaged in the blank apertures and which themselves are moved by the spaced elements.

Parallel movable friction belts 34 and 36 engage the tops of the containers in both the container rows. Upward displacement of the wrapper continues as they move along the loading section as seen with reference to wrappers 'b4' and 'b5' so that the containers progressively are fully located in the wrapper apertures. It will be appreciated that this upward loading movement of the wrappers is affected whilst simultaneous forward feed of the wrappers is continued by the engaged containers, it being understood that any tendency for upward movement of the containers is prevented by engagement of the friction belts 34 and 36 with the container tops. The container bases at this time are supported by a suitable outfeed conveyor 38 which extends beneath the friction belts from the position of blank B5 to the outfeed end of the machine and which continues the forward feed of the mated wrappers and containers together with the forward feed imparted by friction belt conveyors 34 and 36.

At the outfeed end of the machine the side panels of the wrappers engage fixed guides (not shown) positioned in the path of movement of the wrappers so that they are folded into upright position from the position of wrapper blank 'b6' to the position of wrapper blank 'b7'. Further fixed guides cause the reinforcing tabs 't' to be folded into a flat position overlying the tops of the containers in their respective rows as shown at the position of blank 'b8'.

Also at the position of blank 'b8' an application of glue is made by glue guns 40 to both the exposed top surfaces of the reinforcing tabs 't' and to the inner top wall 'ti' of the wrapper, whereafter the inner top wall 'ti' is folded inwardly into horizontal position. At this time forward feed of the partially formed package is augmented by side wall engaging friction belts 42 and 44, respectively.

The main top panel 'tm' of the wrapper is then caused to be folded downwardly by guide elements (not shown) into face contacting relationship with inner top panel 'ti' as at position 'b9'. Thereafter, the package 'P' passes beneath a pressure belt (not shown) to ensure good adhesive contact between the glued panels.

It is to be understood that whereas the above description relates to a double line loading construction, a suitably modified arrangement may provide for a single line of containers to be loaded.

I claim:

1. A method for wrapping a plurality of cup-shaped containers arranged in two rows in a wrapper of the type having a base panel, side wall panels joined to the base panel along longitudinal side edges thereof, and top wall portions joined to said side wall panels along fold lines remote from said side edges of the base panel and arranged to be folded into overlapping relationship, said base panel being provided with two rows of apertures for receiving the lower portions of said containers and reinforcing tabs struck from said apertures and joined thereto along fold lines remote from said longitudinal side edges of said base panel and substantially parallel thereto, which method comprises the steps of (a) continuously feeding a series of wrapper blanks in substantially flat condition from an infeed section toward an outfeed section of a packaging machine, (b) folding said reinforcing tabs out of the plane of said blanks into substantially upright position, (c) simultaneously advancing two linear series of containers into longitudinal alignment with said wrapper so that each container is moved into a postion directly above said wrapper, (d) causing each container to be located in one of said apertures while the containers and said wrapper are conveyed in synchronism, (e) folding the upper portions of said reinforcing tabs outwardly to overlie the tops of the associated containers, (f) folding the side walls into substantially upright position and folding one of the top wall portions into generally horizontal position to overlie the tops of the adjacent containers, (g) folding the other top wall portion into face contacting relationship with the exposed surfaces of said reinforcing tabs and overlapping relationship with said one top wall portion, (h) securing said top wall portions together in overlapping relationship.

2. The method according to claim 3, wherein step (f) is followed by the step of applying adhesive to the exposed surfaces of said reinforcing tabs and said one top wall portion, and wherein step (h) includes the step of applying pressure to said other top wall portion so that the interior surface thereof is caused to adhere to said reinforcing tabs and to said top wall portion.

3. A machine for wrapping a plurality of cup-shaped containers arranged in two rows in a wrapper of the type having a base panel, side wall panels joined to the base panel along longitudinal side edges thereof, and top wall portions joined to said side wall panels along fold lines remote from said side edges of the base panel and arranged to be folded into overlapping relationship, said base panel being provided with two rows of apertures for receiving the lower portions of said containers and reinforcing tabs struck from said apertures and joined thereto along fold lines remote from said longitudinal side edges of said base panel and substantially parallel thereto, which machine comprises (a) means for continuously feeding a series of wrapper blanks in substantially flat condition from an infeed section toward an outfeed section, (b) means for folding said reinforcing tabs out of the plane of said blanks into substantially upright position, (c) means for simultaneously advancing two linear series of containers into longitudinal alignment with said wrapper so that each container is moved into a position directly above said wrapper, (d) means for causing each container to be located in one of said apertures while the containers and said wrapper are conveyed in synchronism through a loading section of the machine, (e) means for folding the upper portions of said reinforcing tabs outwardly to overlie the tops of the associated containers, (f) means for folding the side walls into substantially upright position and folding one of the top wall portions into generally horizontal position to overlie the tops of adjacent containers, (g) means for applying adhesive to the exposed horizontal surfaces of said reinforcing tabs and to said one top wall portion, (h) means for folding the other top wall portion into face contacting relationship with the exposed surfaces of said reinforcing tabs and overlapping relationship with said one top wall portion, (i) means for applying pressure to said other top wall portion so that the interior surface thereof is caused to adhere to said reinforcing tabs and to said one top wall portion.

* * * * *